US006824434B2

(12) United States Patent
Kitsu et al.

(10) Patent No.: US 6,824,434 B2
(45) Date of Patent: Nov. 30, 2004

(54) OUTBOARD MOTOR

(75) Inventors: Kunihiro Kitsu, Saitama (JP); Kouichi Oka, Saitama (JP); Michiharu Ohkawa, Saitama (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/606,932

(22) Filed: Jun. 27, 2003

(65) Prior Publication Data

US 2004/0110430 A1 Jun. 10, 2004

(30) Foreign Application Priority Data

Jul. 1, 2002 (JP) ..... 2002-191788
Jul. 1, 2002 (JP) ..... 2002-191789

(51) Int. Cl.[7] ..... B63H 5/125
(52) U.S. Cl. ..... 440/53; 440/61 R
(58) Field of Search ..... 440/53, 55, 56, 440/61 R, 64, 65; 248/640, 641, 642, 643

(56) References Cited

U.S. PATENT DOCUMENTS 5,049,099 A * 9/1991 Ito et al. ..... 440/61 R
5,156,561 A * 10/1992 Kinoshita ..... 440/61 R
5,358,436 A * 10/1994 Soda et al. ..... 440/61 R
6,139,380 A * 10/2000 Uematsu ..... 440/61 D
6,183,320 B1 * 2/2001 Natsume ..... 440/53
6,309,265 B1 * 10/2001 Oguma ..... 440/61 R
6,398,601 B1 * 6/2002 Oguma ..... 440/53

FOREIGN PATENT DOCUMENTS

JP 4-5190 1/1992

* cited by examiner

*Primary Examiner*—Lars A. Olson
(74) *Attorney, Agent, or Firm*—Arent Fox PLLC

(57) ABSTRACT

An outboard motor includes upper and lower pivot shafts provided respectively in a swivel case and a pair of left and right stern brackets supporting the swivel case via a tilt shaft. Upper and lower end portions of an extendable part of a tilt system are mounted on the upper and lower pivot shafts. First and second mounting parts are provided on the upper pivot shaft so that they are offset in mutually opposite left and right directions from a central position between the pair of stern brackets. The offset of the second mounting part is set smaller than the offset of the first mounting part. Consequently, either a gas-assist type or power type tilt system can be mounted with good balance between the left and right stern brackets, thereby improving the appearance.

6 Claims, 13 Drawing Sheets

OUTBOARD MOTOR

BACKGROUND OF THE INVENTION

1. Field of the Invention

The present invention relates to an improvement of an outboard motor comprising a swivel case axially and steerably supporting a propulsion unit, a pair of left and right stern brackets disposed on left and right sides of the swivel case and supporting the swivel case in a vertically tiltable manner via a tilt shaft, and an upper pivot shaft and a lower pivot shaft that are parallel to the tilt shaft and are provided in the swivel case and the left and right stern brackets respectively, upper and lower end portions of an extendable part of a tilt system being mounted on the upper and lower pivot shafts.

2. Description of the Related Art

When a tilt system is mounted in a conventional outboard motor, as disclosed in, for example, Japanese Patent Application Laid-open No. 4-5190, one mounting part is provided on a central part of each of upper and lower pivot shafts. In the case of both a gas-assist type tilt system and a power type tilt system, upper and lower end portions thereof are mounted on the corresponding mounting parts provided on each of the upper and lower pivot shafts at central positions between left and right stern brackets.

In general, the gas-assist type tilt system employs an accumulator tank provided so as to be connected to one side of an assist cylinder and having a comparatively small diameter in the same way as the assist cylinder, whereas the power type tilt system employs a hydraulic pump and an electric motor provided so as to be connected to one side of a hydraulically operated cylinder and having larger diameters than that of the hydraulically operated cylinder. Therefore, if the assist cylinder or the hydraulically operated cylinder is mounted on the mounting parts in the center of the upper and lower pivot shafts, then the accumulator tank or the hydraulic pump and the electric motor are offset leftward or rightward from the central position between the left and right stern brackets, and consequently the entire tilt system is offset from the central position between the two stern brackets, thus impairing the appearance of the outboard motor.

SUMMARY OF THE INVENTION

The present invention has been achieved in view of the above-mentioned circumstances, and it is an object thereof to provide an outboard motor wherein either a gas-assist type or a power type tilt system can be mounted with good balance between left and right stern brackets, thereby improving the appearance.

In order to accomplish the above object, a first aspect of the present invention provides an outboard motor that includes a swivel case axially and steerably supporting a propulsion unit, a pair of left and right stern brackets disposed on left and right sides of the swivel case and supporting the swivel case. In a vertically tiltable manner via a tilt shaft, and upper and lower pivot shafts that are parallel to the tilt shaft and are provided in the swivel case and the left and right stern brackets respectively, upper and lower end portions of an extendable part of a tilt system being mounted on the upper and lower pivot shafts, wherein the upper pivot shaft includes first and second mounting parts that are offset in mutually opposite left and right directions from a central position between the pair of stern brackets, the offset of the second mounting part is set smaller than the offset of the first mounting part, and the upper end portion of the extendable part of the tilt system is mounted selectively on one of the first and second mounting parts according to the type of tilt system.

The tilt system corresponds to a power type tilt system 16P and a gas-assist type tilt system 16G of an embodiment of the present invention which will be described later, and the extendable part of the tilt system corresponds to a hydraulically operated cylinder 30 and an assist cylinder 40.

In accordance with this first aspect, since the upper end portion of the extendable part of the tilt system is selectively mounted on one of the first and second mounting parts of the upper pivot shaft according to the type of tilt system, by adjusting the size of a space formed beneath the other mounting part which is not used and arranging in this space an auxiliary equipment of the tilt system according to the size of the space, the entirety of the tilt system irrespective of the type can be arranged in the central position between the left and right stern brackets, thus achieving a good appearance of the outboard motor and a good weight balance in the left and right directions.

Furthermore, in accordance with a second aspect of the present invention, in addition to the first aspect, there is provided an outboard motor wherein the tilt system is of a power type in which a hydraulic pump and an electric motor are connected to one side of a hydraulically operated cylinder, an upper end part of the hydraulically operated cylinder is mounted on the first mounting part, and the hydraulic pump and the electric motor are disposed on the second mounting part side.

In accordance with this second aspect, the entire power type tilt system can be arranged in the central position between the left and right stern brackets, thus achieving a good appearance of the outboard motor and a good weight balance in the left and right directions.

Moreover, in accordance with a third aspect of the present invention, in addition to the first aspect, there is provided an outboard motor wherein the tilt system is of a gas-assist type in which a cylindrical accumulator tank is connected to one side of an assist cylinder, an upper end part of the assist cylinder is mounted on the second mounting part, and the accumulator tank is disposed on the first mounting part side.

In accordance with this third aspect, the entire gas-assist type tilt system can be arranged in the central position between the left and right stern brackets, thus achieving a good appearance of the outboard motor and a good weight balance in the left and right directions.

Furthermore, in accordance with a fourth aspect of the present invention, in addition to the first aspect, there is provided an outboard motor wherein the pair of left and right stern brackets are provided with a plurality of sets of pairs of left and right adjustment holes arranged in the vertical direction, a stopper pin that determines the tilted down position of the propulsion unit by receiving a stopper surface formed on a front surface of the swivel case is inserted through and supported selectively in one pair of the plurality of sets of adjustment holes so as to adjust the tilted down position of the propulsion unit in a plurality of steps, the swivel case has a second stopper surface formed below the stopper surface, the stern brackets have formed thereon a stopper wall that defines the lowest tilted down position of the propulsion unit by receiving the second stopper surface when the stopper pin is detached from the adjustment holes, and these stern brackets are provided with retention holes that retain the stopper pin detached from the adjustment hole.

In accordance with this fourth aspect, the number of adjustment positions of the tilted down position of the propulsion unit can be increased by one step with a very simple structure in which the second stopper surface is formed on the swivel case below the stopper surface and the stopper walls are formed on the stern brackets, the stopper walls defining the lowest tilted down position of the propulsion unit by receiving the second stopper surface when the stopper pin is detached from the adjustment holes. As a result, since it is unnecessary to increase the number of pairs of adjustment holes, there is no need to enlarge portions of the stern brackets where adjustment holes are to be provided, nor decrease in the turning angle of the propulsion unit. Moreover, in the case where the stopper pin is not in use, it can be retained in the retention holes of the stern brackets, thereby preventing it from being lost.

Furthermore, in accordance with a fifth aspect of the present invention, in addition to the fourth aspect, there is provided an outboard motor wherein, when the second stopper surface is received by the stopper wall, the swivel case is held between the two stern brackets.

In accordance with this fifth aspect, when the propulsion unit is trimmed to the lowest tilted down position, the lateral load acting on the swivel case can be firmly supported by the left and right stern brackets.

Moreover, in accordance with a sixth aspect of the present invention, in addition to the fourth or fifth aspect, there is provided an outboard motor wherein, when the stopper pin is inserted into the adjustment holes or the retention holes, a retaining key is axially supported on one end part of the stopper pin so that the retaining key can pivot between a dropped down position in which the retaining key is coaxial with the stopper pin and can pass through the adjustment holes or the retention holes together with the stopper pin, and a raised position in which the retaining key abuts against an outer side surface of one of the stern brackets, and a spring is fitted to the other end part of the stopper pin, the spring being compressed against an outer side surface of the other stern bracket and biasing the stopper pin in a direction opposite to the retaining pin.

In accordance with this sixth aspect, fitting of the stopper pin into the adjustment holes and the retaining holes and detachment therefrom can be carried out simply, and when the stopper pin is fitted the raised position of the retaining key can be maintained by the resilient force of the spring and noise due to rattling can be prevented.

The above-mentioned object, other objects, characteristics, and advantages of the present invention will become apparent from an explanation of preferred embodiments, which will be described in detail below, by reference to the attached drawings.

DESCRIPTION OF THE PREFERRED EMBODIMENT

A preferred embodiment of the present invention is explained below by reference to the attached drawings.

In the explanation below, the terms 'front' ('forward'), 'rear' ('reverse'), 'left', and 'right' are used with reference to a hull on which an outboard motor is mounted.

Figure 1:
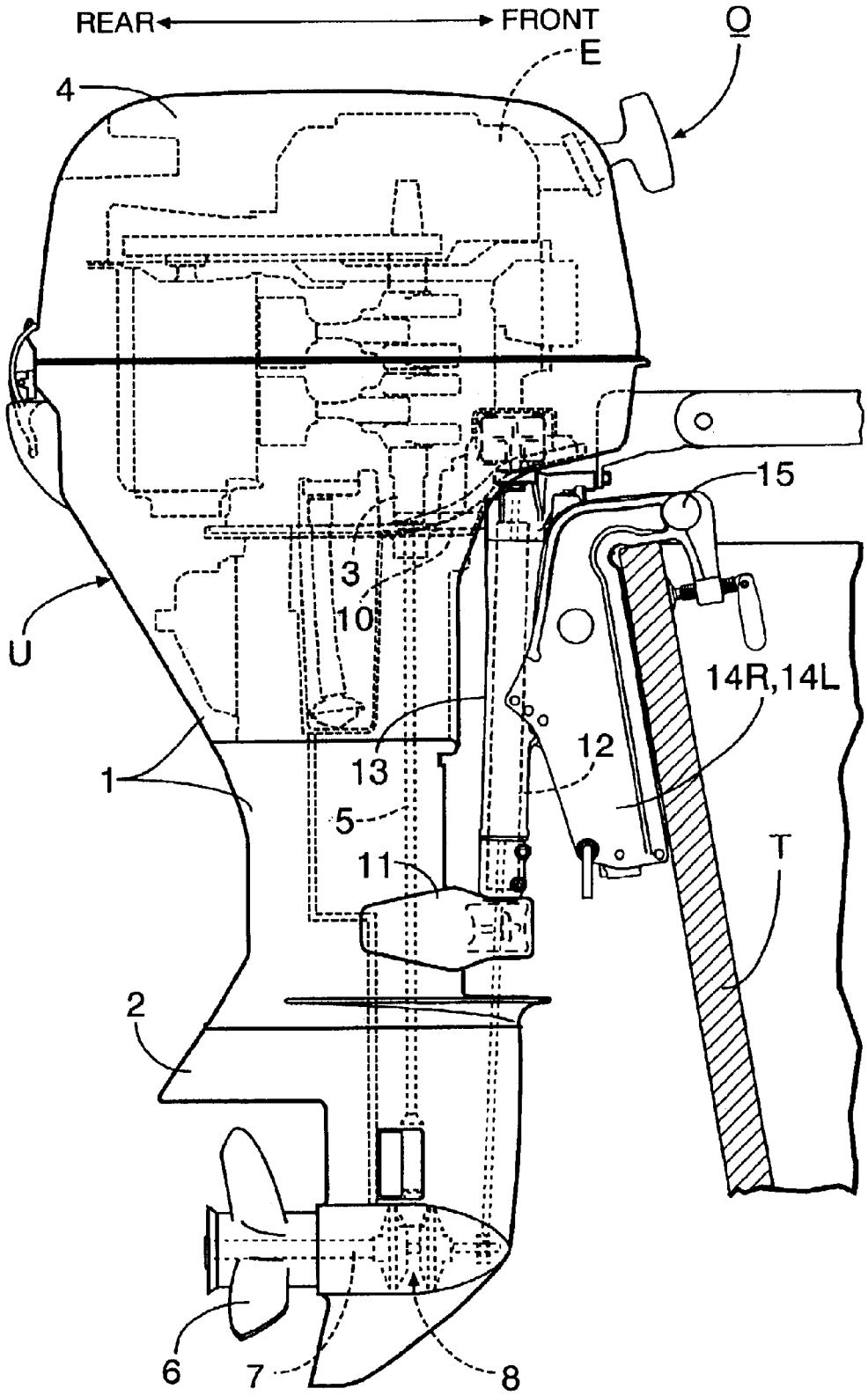
FIG. 1 is a side view of an outboard motor.

Referring firstly to FIG. 1, a propulsion unit U of an outboard motor O includes an extension case 1 and a gear case 2 that is joined to a lower part of the extension case 1. A water-cooled multi-cylinder four-stroke engine E is mounted in an upper part of the extension case 1 so that a crankshaft 3 is vertical. An engine hood 4 covering the engine E is mounted on an upper end part of the extension case 1 so that the hood can be opened and closed.

Connected to the crankshaft 3 of the engine E is a drive shaft 5 disposed vertically within the extension case 1. Supported in the gear case 2 is a propeller shaft 7 to the rear end of which a propeller 6 is fixed. Housed within the gear case 2 is a forward/reverse switch-over device 8 which connects the drive shaft 5 to the propeller shaft 7. While the engine E is being operated, the power transmitted from the crankshaft 3 to the drive shaft 5 is therefore transmitted to the propeller shaft 7 via the forward/reverse switch-over device 8. The rotational direction of the propeller shaft 7 is controlled by the forward/reverse switch-over device 8.

Vertically opposite ends of a swivel shaft 12 are fixed to an upper arm 10 and a lower arm 11. The upper arm 10 supports an upper part of the extension case 1, and the lower arm 11 supports a lower part of the extension case 1. A swivel case 13 rotatably supports the swivel shaft 12 and is connected via a horizontal tilt shaft 15 to a pair of left and right stern brackets 14L and 14R clamped to a transom T of a hull with the swivel case 13 interposed therebetween. The propulsion unit U therefore can tilt vertically around the tilt shaft 15.

Figure 2:
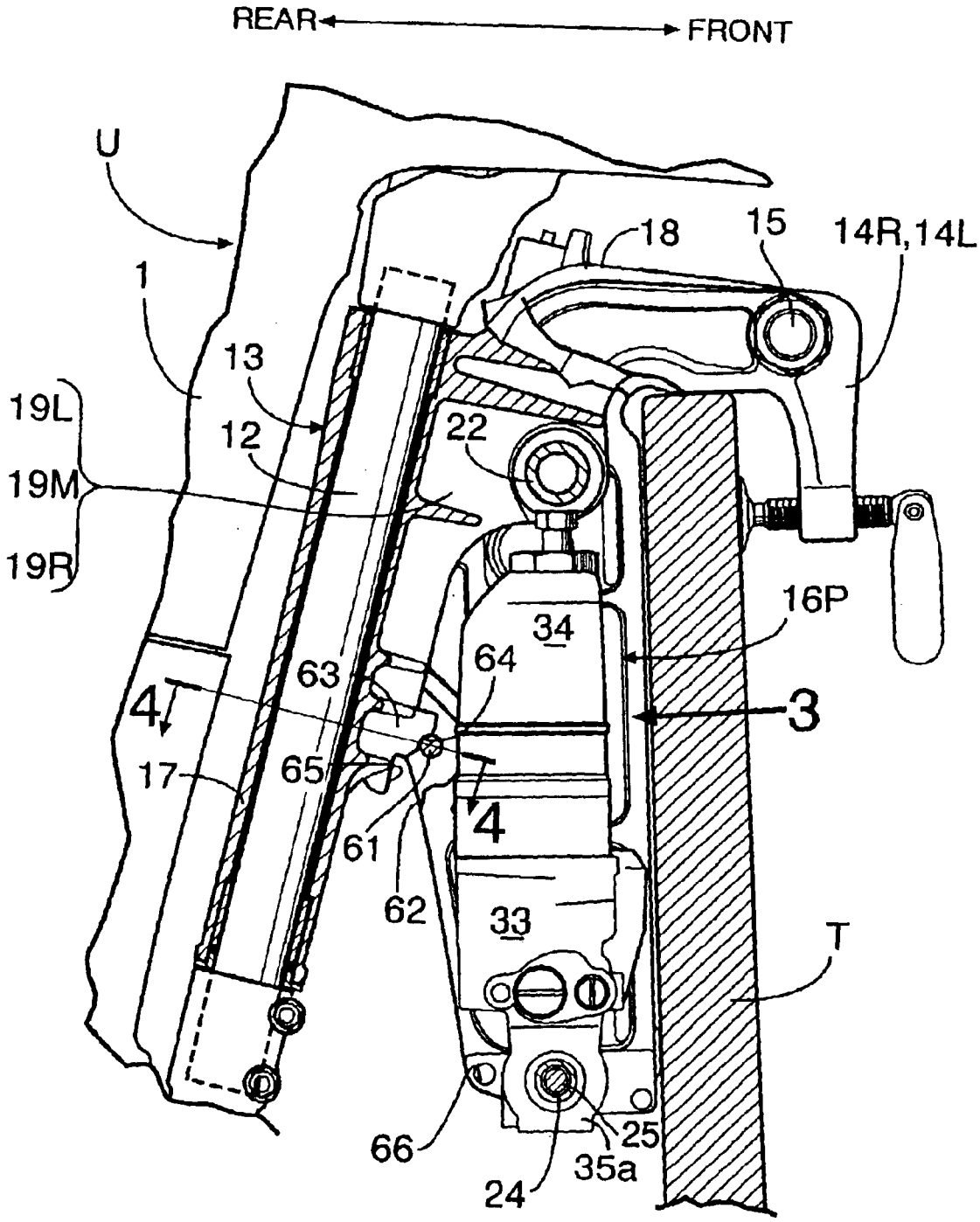
FIG. 2 is a vertical cross-sectional side view of a part of FIG. 1 showing a mode in which a power type tilt system is mounted.
Figure 3:
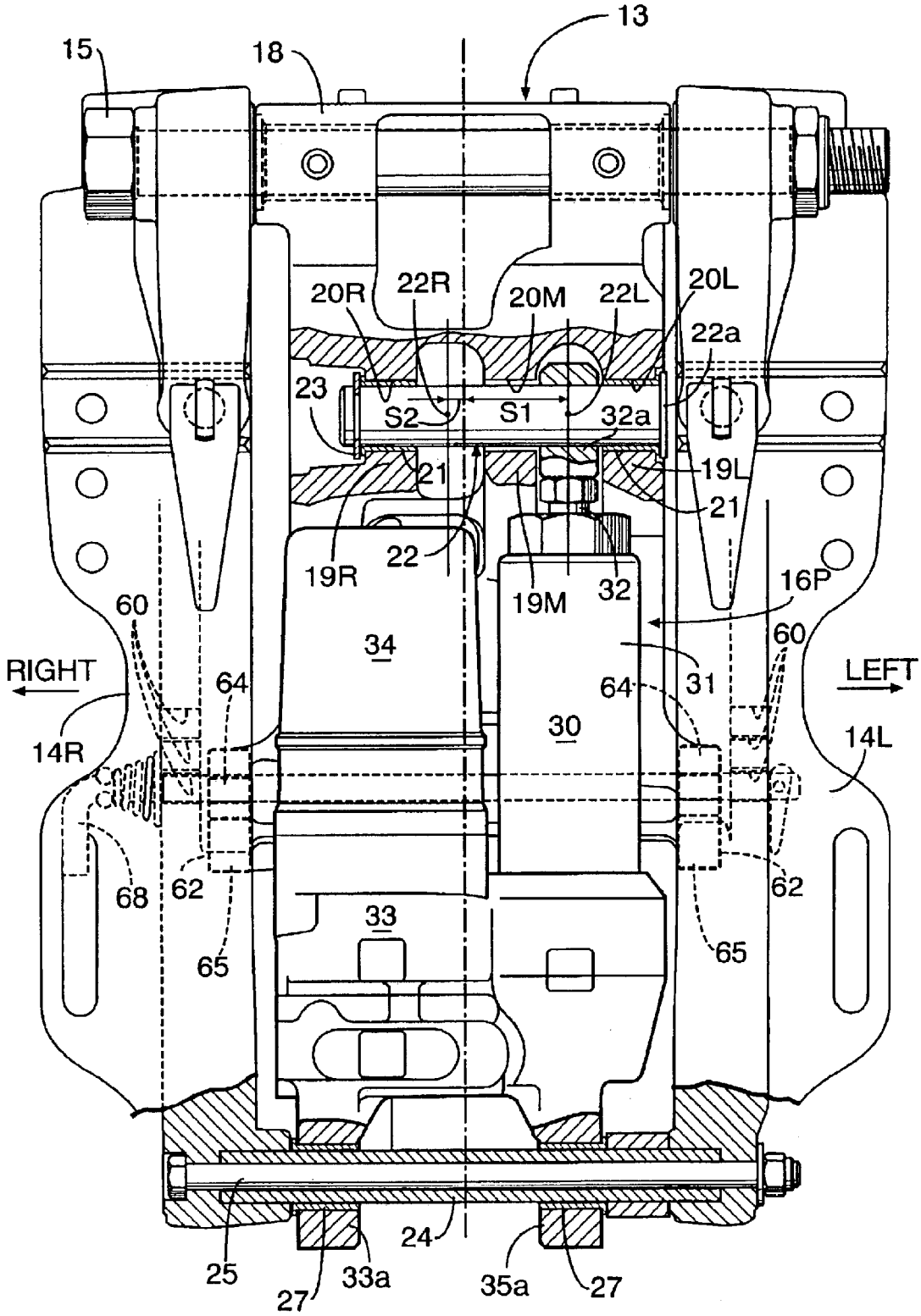
FIG. 3 is a view from arrow 3 in FIG. 2.

As shown in FIGS. 2 and 3, the swivel case 13 includes a cylindrical case part 17 and an arm part 18. The case part 17 directly supports the swivel shaft 12. The arm part 18 extends forward (to the hull side) from an upper part of the case part 17, and is supported on the tilt shaft 15. Formed between the case part 17 and the arm part 18 are three ribs 19L, 19M, and 19R, which extend vertically and are arranged laterally at regular intervals. Coaxially bored in the ribs 19L and 19R which are on the left and right outer opposite sides, are bearing holes 20L and 20R which are disposed parallel to the tilt shaft 15. Bored in the middle rib 19M is a through hole 20M which has the same diameter as that of the bearing holes 20L and 20R and which is coaxially arranged therewith. Opposite end parts of an upper pivot shaft 22 running through the through hole 20M are rotatably supported by the two bearing holes 20L and 20R via bushes 21. The upper pivot shaft 22 has a flange 22*a* formed at its left end and a stopper ring 23 secured to its right end part. Making the flange 22*a* and the stopper ring 23 abut respectively against the outer side surfaces of the rib 19L and the rib 19R, restricts the axial movement of the upper pivot shaft 22. In this way, on the upper pivot shaft 22, a second mounting part 22R is provided between the right rib 19M and the middle rib 19M, and a first mounting part 22L is provided between the left rib 19L and the middle rib 19M. These first and second mounting parts 22L and 22R are disposed so as to be offset from a central position between the left and right stern brackets 14L and 14R, and an offset S2 of the second mounting part 22R is set smaller than an offset S1 of the first mounting part 22L.

A lower pivot shaft 24 is disposed parallel to the upper pivot shaft 22 between lower end parts of the left and right stern brackets 14L and 14R. This lower pivot shaft 24 has its opposite end parts fitted into the inner walls of the left and right stern brackets 14L and 14R, and is fixed to the two stern brackets 14L and 14R via a long bolt 25 running through a hollow part of the lower pivot shaft 24.

Figure 10:
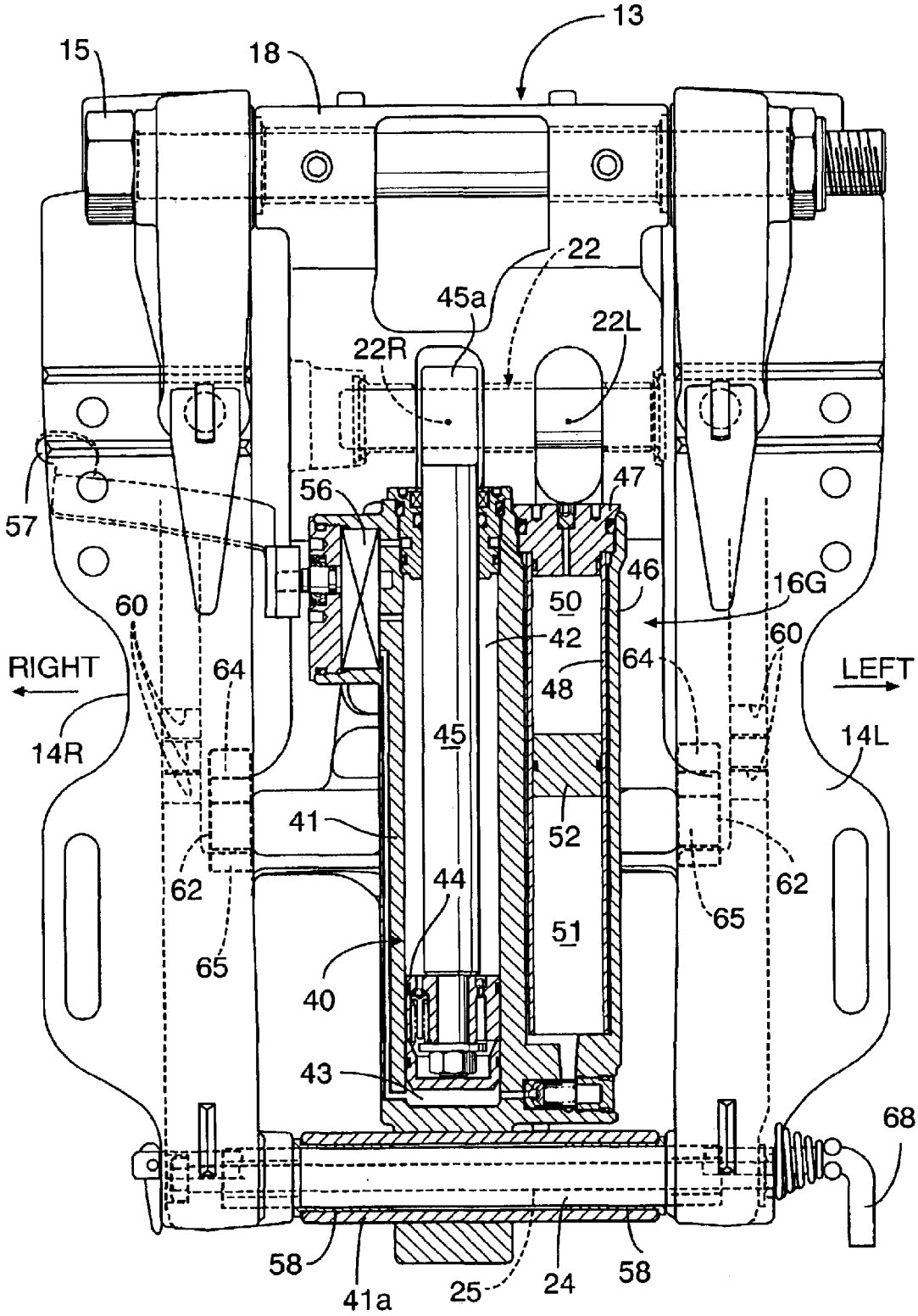
FIG. 10 is a cross sectional view taken along line 10—10 in FIG. 9.

A tilt system for tilting the propulsion unit U as described above is mounted between the two pivot shafts 22 and 24. There are two types of tilt system, that is, a power type tilt system 16P and a gas-assist type tilt system 16R (FIG. 10). In the present invention, either of the two types of tilt systems 16P and 16R can be mounted on the two pivot shafts 22 and 24.

A mode for mounting the power type tilt system 16P is firstly explained by reference to FIGS. 2 to 8.

A hydraulically operated cylinder 30 of the power type tilt system 16P is formed from a cylinder main body 31, an operating piston (not illustrated), and a piston rod 32. The operating piston is fitted within a cylinder bore of the cylinder main body 31 to define upper and lower chambers therewithin. The piston rod 32 is fixed to the operating piston and projects upward from the cylinder main body 31. Mounted on a lower right part of the cylinder main body 31 is a hydraulic pump 33 capable of supplying hydraulic pressure alternately to the upper and lower chambers within the cylinder main body 31. An electric motor 34 for driving the hydraulic pump 33 is connected to an upper part of the hydraulic pump 33. Joined to the upper end of the piston rod 32 is a connecting ring 32*a,* which is supported by the first mounting part 22L of the upper pivot shaft 22. Formed integrally at the lower ends of the cylinder main body 31 and the hydraulic pump 33 are connecting bosses 31*a* and 33*a,* which are supported by the lower pivot shaft 24. The hydraulic pump 33 and the electric motor 34 have larger diameters than that of the hydraulically operated cylinder 30.

When the hydraulic pump 33 is operated by forward or reverse rotation of the electric motor 34, the hydraulic pump 33 supplies hydraulic pressure alternately to the upper and lower chambers of the hydraulically operated cylinder 30, thus expanding (see FIGS. 7 and 8) or contracting (see FIGS. 2 and 3) the hydraulically operated cylinder 30 to automatically tilt the propulsion unit U up or down.

Although the hydraulic pump 33 and the electric motor 34 generally have larger diameters than that of the hydraulically operated cylinder 30, since the first mounting part 22L, which supports the hydraulically operated cylinder 30, of the upper pivot shaft 22 is offset leftward from the central position between the left and right stern brackets 14L and 14R by the comparatively large offset S1, a comparatively large space is provided between the hydraulically operated cylinder 30 and the right stern bracket 14R. The electric motor 34 and the hydraulic pump 33 integrally connected to the right side of the hydraulically operated cylinder 30 are arranged effectively using this space. As a result, the entire power type tilt system 16P is arranged in the central position between the two stern brackets 14L and 14R, thus achieving a good lateral weight balance of the outboard motor O as well as a good appearance.

A mode of mounting the gas-assist type tilt system 16G is now explained by reference to FIGS. 9 to 13.

Figure 11:
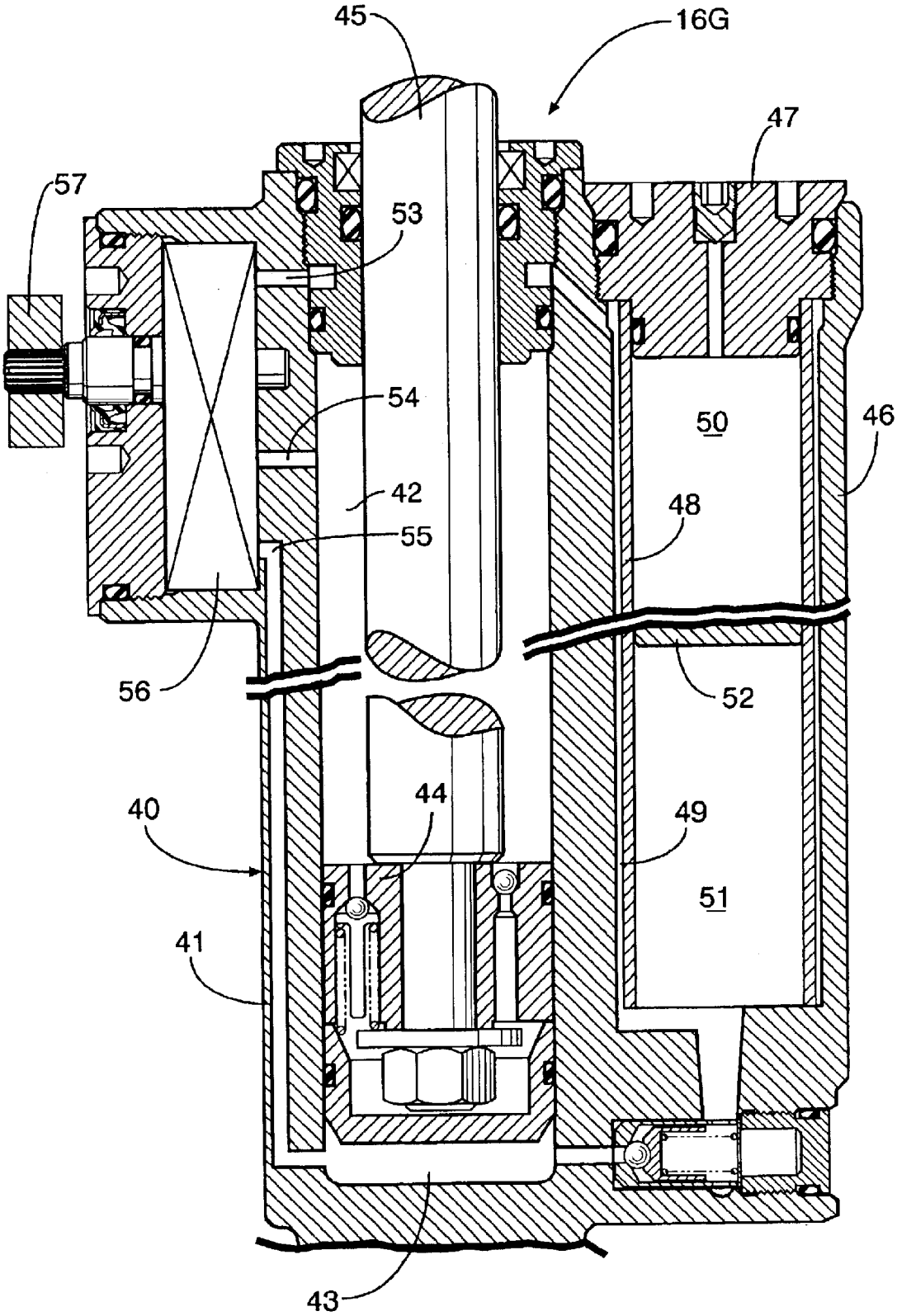
FIG. 11 is an enlarged view of an essential part in FIG. 10.
Figure 12:
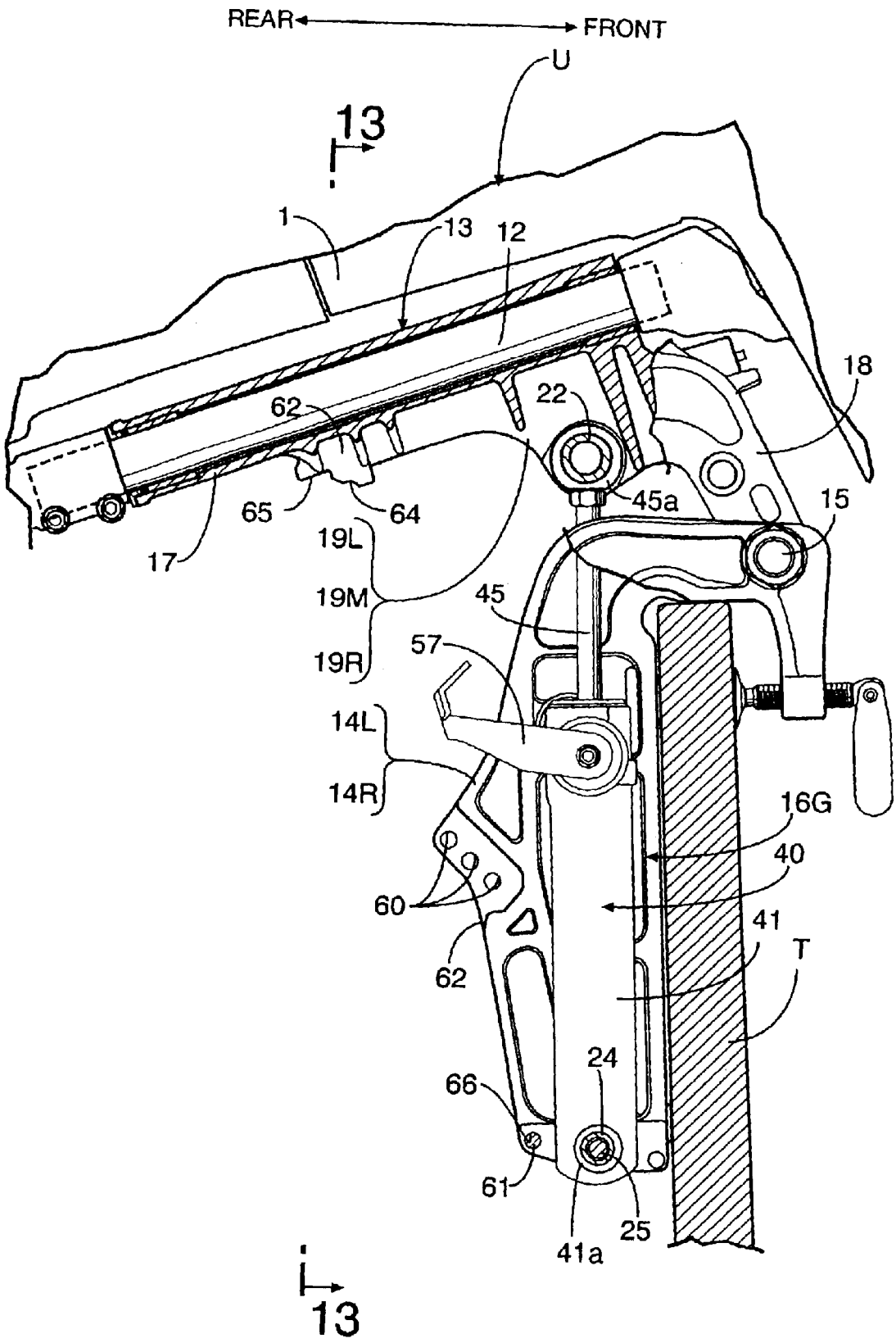
FIG. 12 is a view, corresponding to FIG. 9, showing a tilted up state of a propulsion unit.
Figure 13:
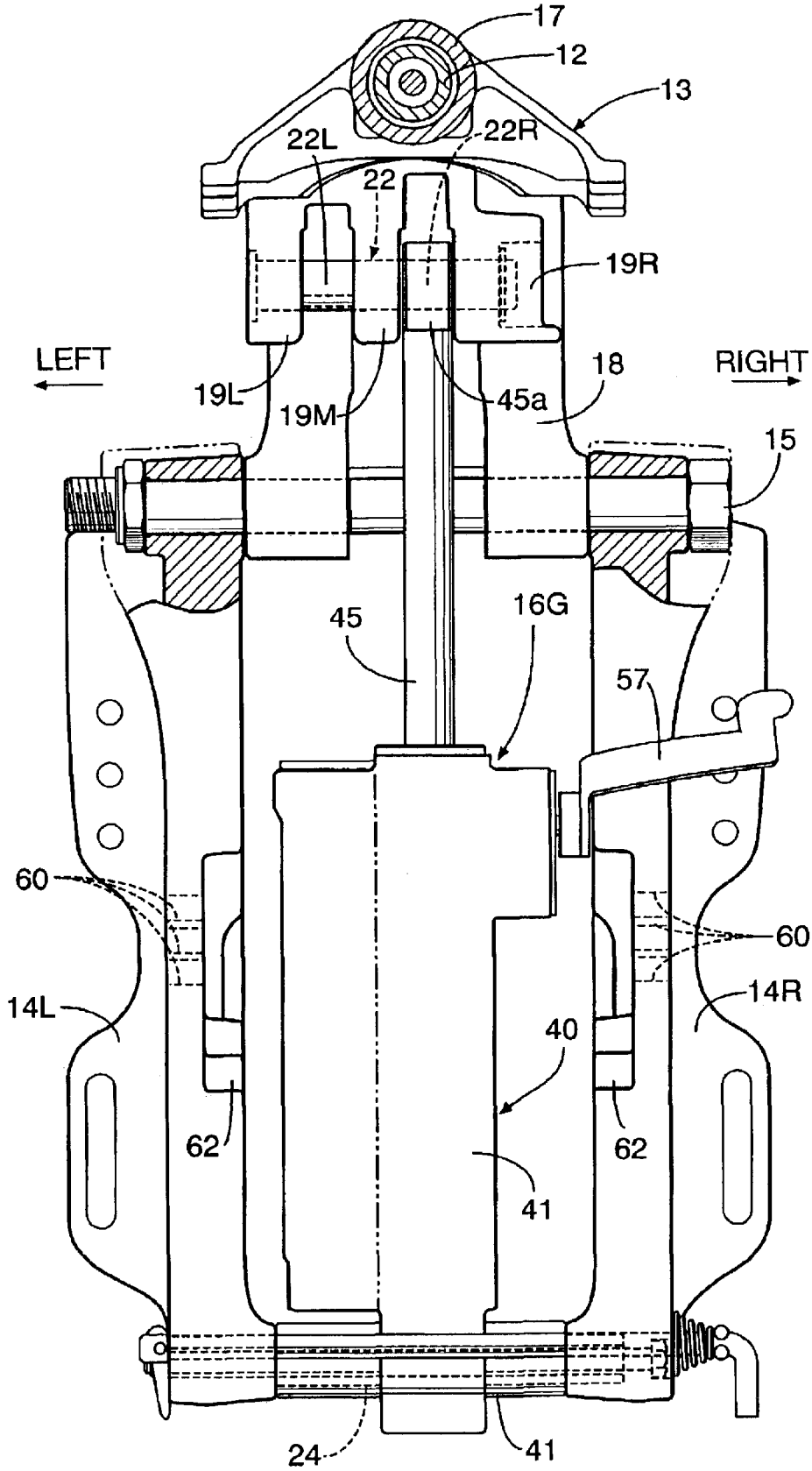
FIG. 13 is a cross sectional view taken along line 13—13 in FIG. 12.

As shown in FIGS. 10 and 11, an assist cylinder 40 of the gas-assist type tilt system 16G is formed from a cylinder main body 41, an operating piston 44, and a piston rod 45. The operating piston 44 is slidably fitted within a cylinder bore of the cylinder main body 41 and defines an upper oil chamber 42 and a lower oil chamber 43 therewithin. The piston rod 45 is fixed to the operating piston 44, runs through the upper oil chamber 42, and extends upward from the cylinder main body 41. Formed integrally on the left side of the cylinder main body 41 is a cylindrical accumulator tank 46, which is parallel to the cylinder main body 41. This accumulator tank 46 has substantially the same diameter as that of the assist cylinder 40. A connecting ring 45*a* is integrally joined to the outer end of the piston rod 45 by welding or the like, and is supported by the second mounting part 22R of the upper pivot shaft 22 as shown in FIG. 10. A connecting tube 41*a* is fixed to a lower end part of the cylinder main body 41 by surround casting or press fitting, and is pivotably supported on the lower pivot shaft 24 via a pair of left and right bushes 58.

Referring again to FIG. 10, an inner tube 48 is disposed within the accumulator tank 46 and fixed to a lid 47 in an upper part of the accumulator tank 46. The lower end of the inner tube 48 is open and communicates with a cylindrical oil passage 49 between the accumulator tank 46 and the inner tube 48. A free piston 52 is slidably fitted within the inner tube 48 to define an upper high-pressure gas chamber 50 and a lower hydraulic chamber 51. High-pressure gas having a predetermined pressure is sealed in the high-pressure gas chamber 50, and the hydraulic chamber 51 is filled with an operating oil. Bored in an upper part of the cylinder main body 41 on one side are a first port 53 communicating with the cylindrical oil passage 49, a second port 54 communicating with the upper oil chamber 42, and a third port 55 communicating with the lower oil chamber 43. A control valve 56 capable of simultaneously opening and closing these first to third ports 53 to 55 is also provided in the upper part of the cylinder main body 41 on said one side. This control valve 56 is operated by a manual lever 57.

When the control valve 56 is opened, the free piston 52 descends with the pressure of the high-pressure gas chamber 50 to supply the operating oil within the hydraulic chamber 51 from the cylindrical oil passage 49 via the first and second ports 53 and 54 to the upper oil chamber 42, and at the same time to the lower oil chamber 43 via the first port 53 and the third port 55, thus applying the pressure of the high-pressure gas chamber 50 to both the upper and lower faces of the operating piston 44. Since the pressure-receiving area of the upper end of the operating piston 44 is smaller than the pressure-receiving area of the lower end thereof by the area of the cross section of the piston rod 45, an upward thrust that is equal to the product of the difference in area and the above pressure is applied to the operating piston 44, and this thrust substantially counterbalances the moment around the tilt shaft 15 due to the self-weight of the propulsion unit U. A user can therefore easily tilt the propulsion unit U up or down while expanding (see FIGS. 12 and 13) or contracting (see FIGS. 9 and 10) the assist cylinder 40 by placing his hand on the engine hood 4 and applying an operating force to the propulsion unit U in a tilt-up or tilt-down direction. When the control valve 56 is closed, since all of the first to third ports 53 to 55 are closed, connections between the cylindrical passage 49 and the upper and lower oil chambers 42 and 43 are cut off, thus hydraulically holding the operating piston 44 at a desired position.

Since the offset S2 of the second mounting part 22R, which supports the assist cylinder 40, of the upper pivot shaft 22 from the central position between the left and right stern brackets 14L and 14R is comparatively small, the assist cylinder 40 is positioned in the vicinity of the central position between the left and right stern brackets 14L and 14R. Moreover, since the cylindrical accumulator tank 46 formed on the left side of the assist cylinder 40, that is, on the first mounting part 22L side has a comparatively small diameter in the same way as the assist cylinder 40, the entire gas-assist type tilt system 16G is effectively arranged centrally between the two stern brackets 14L and 14R, thus achieving a good lateral weight balance of the outboard motor O and a good appearance.

A trim system that adjusts the tilted down position of the propulsion unit U is now explained by reference to FIGS. 2 to 6.

Bored in the left and right stern brackets 14L and 14R are a plurality of sets of pairs of vertically arranged left and right adjustment holes 60, into one pair of which a stopper pin 61 is selectively fitted. Moreover, stopper walls 62 are integrally formed on inner side surfaces of the left and right stern brackets 14L and 14R below the group of adjustment holes 60, the stopper walls 62 facing the swivel case 13.

A pair of left and right stopper walls 63 are projectingly provided integrally on a front face of the swivel case 13. Formed on the pair of stopper walls 63 are arch-shaped first stopper surfaces 64 and flat second stopper surfaces 65 positioned below the first stopper surfaces 64.

The tilted down position of the propulsion unit U can be set by making the first stopper surfaces 64 of the swivel case 13 abut against the stopper pin 61 selectively fitted into one pair of the adjustment holes 60 of the left and right stern brackets 14L and 14R. The tilted down position of the propulsion unit U can be adjusted by changing the position where the stopper pin 61 is fitted into the adjustment holes 60. In this case, the left and right stopper walls 63 of the swivel case 13 are held between the left and right stern brackets 14L and 14R, thus preventing lateral movement of the swivel case 13. The lateral load acting on the swivel case 13 can therefore be firmly supported by the left and right stern brackets 14L and 14R. Furthermore, the lowest tilted down position of the propulsion unit U can be set by detaching the stopper pin 61 from the adjustment holes 60 and making the second stopper surfaces 65 of the swivel case 13 abut against the stopper walls 62 of the stern brackets 14L and 14R. Here also the left and right stopper walls 63 of the swivel case 13 are held between the left and right stern brackets 14L and 14R, thereby preventing lateral movement of the swivel case 13. Also In this case, the lateral load acting on the swivel case 13 can be firmly supported by the left and right stern brackets 14L and 14R. Since the lowest tilted down position of the propulsion unit U can be set by making the stopper walls 62 abut against the second stopper walls 65 as described above, the number of adjustment steps for the tilted down position of the propulsion unit U can be increased accordingly. It is therefore not necessary to increase the number of sets of adjustment holes 60, leading to no need of enlarging portions of the stern brackets 14L and 14R where adjustment holes 60 are to be bored, nor decrease in the turning angle of the propulsion unit. Moreover, in the case where the stopper pin 61 is not in use, it can be retained in retention holes 66 of the stern brackets 14L and 14R, which will be described below, thereby preventing it from being lost.

Figure 4:
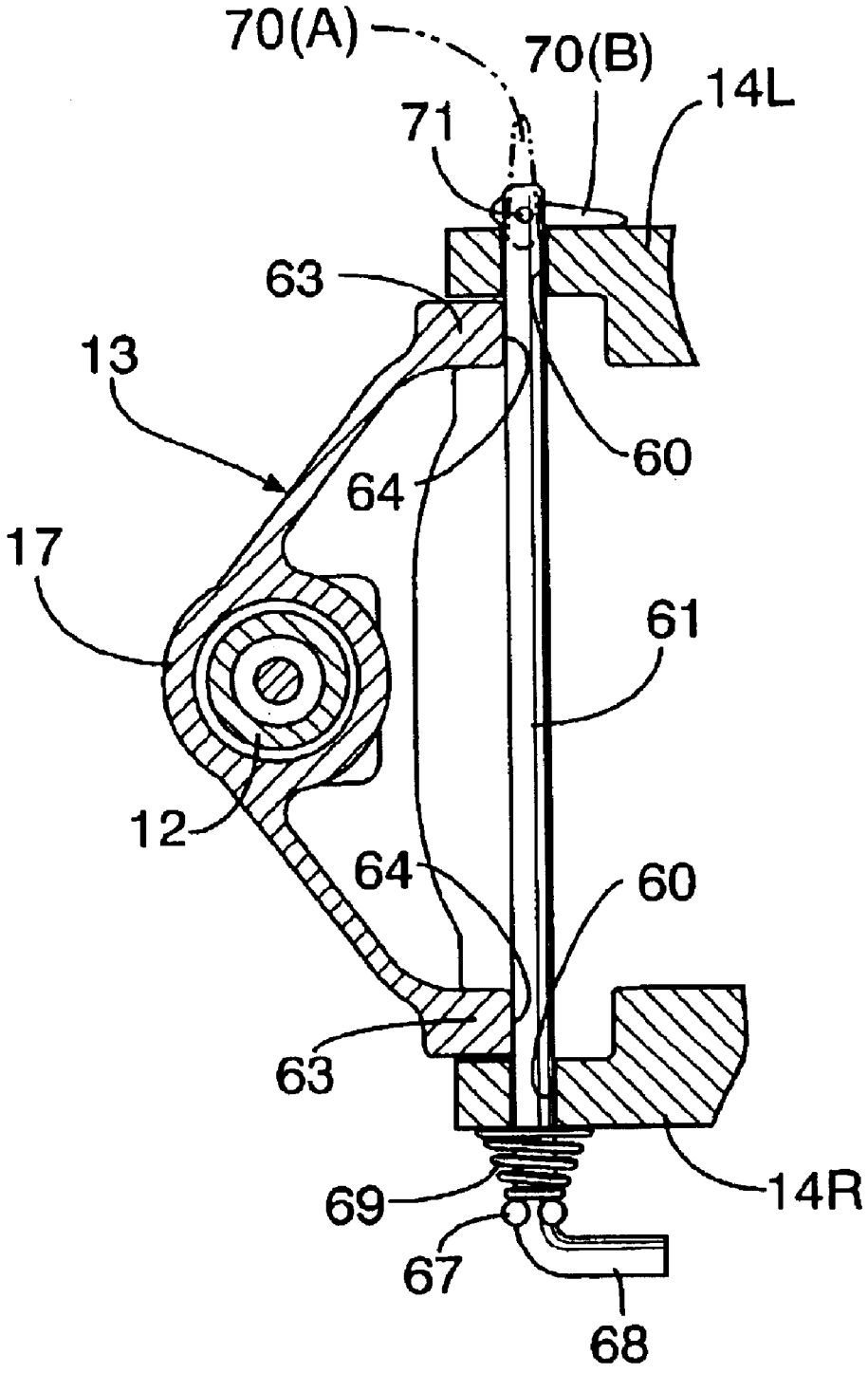
FIG. 4 is a cross sectional view taken along line 4—4 in FIG. 2.
Figure 5:
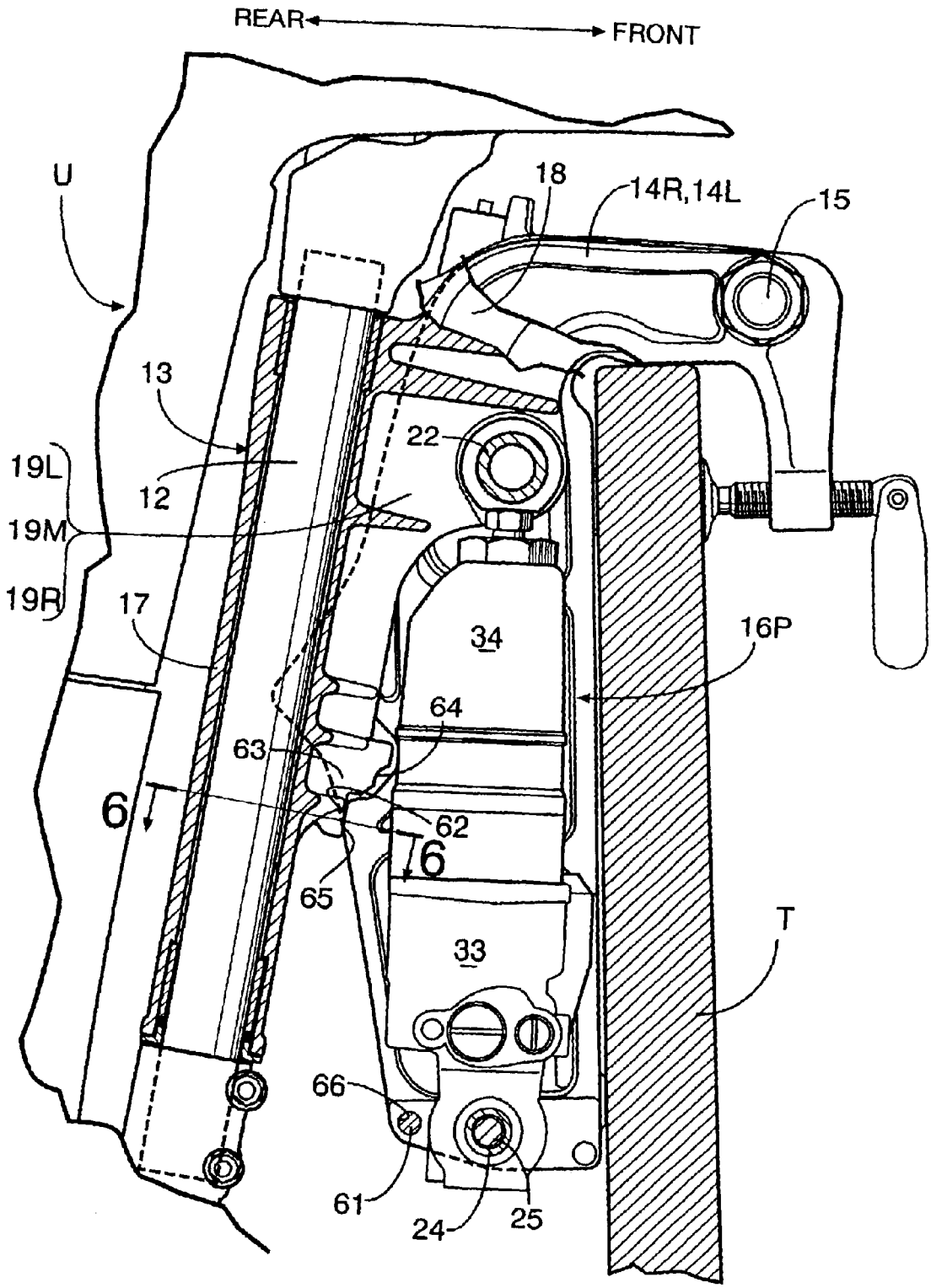
FIG. 5 is a view, corresponding to FIG. 2, showing the lowest tilted down state of a propulsion unit.
Figure 6:
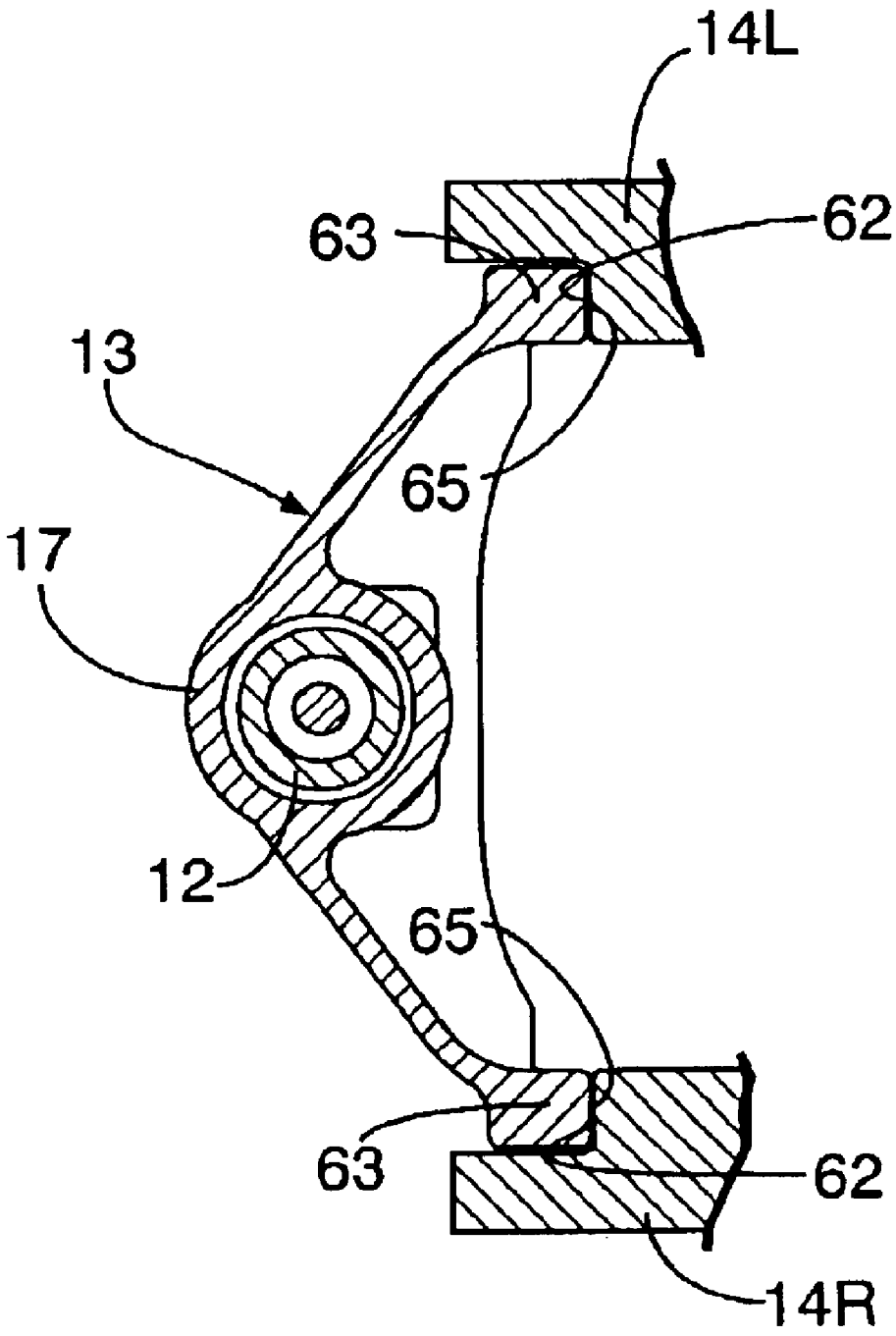
FIG. 6 is a cross sectional view taken along line 6—6 in FIG. 5.
Figure 7:
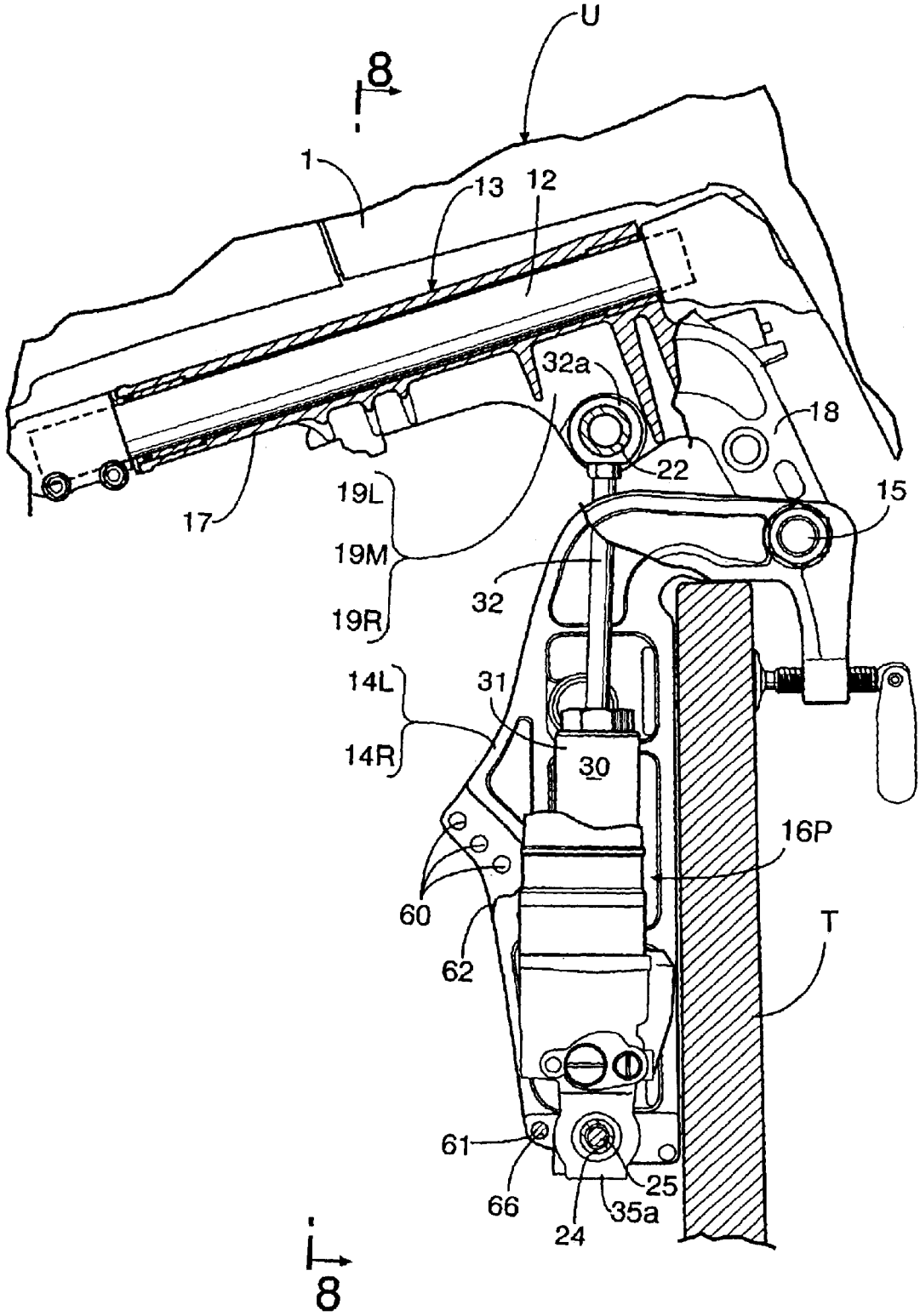
FIG. 7 is a view, corresponding to FIG. 2, showing a tilted up state of the propulsion unit.
Figure 8:
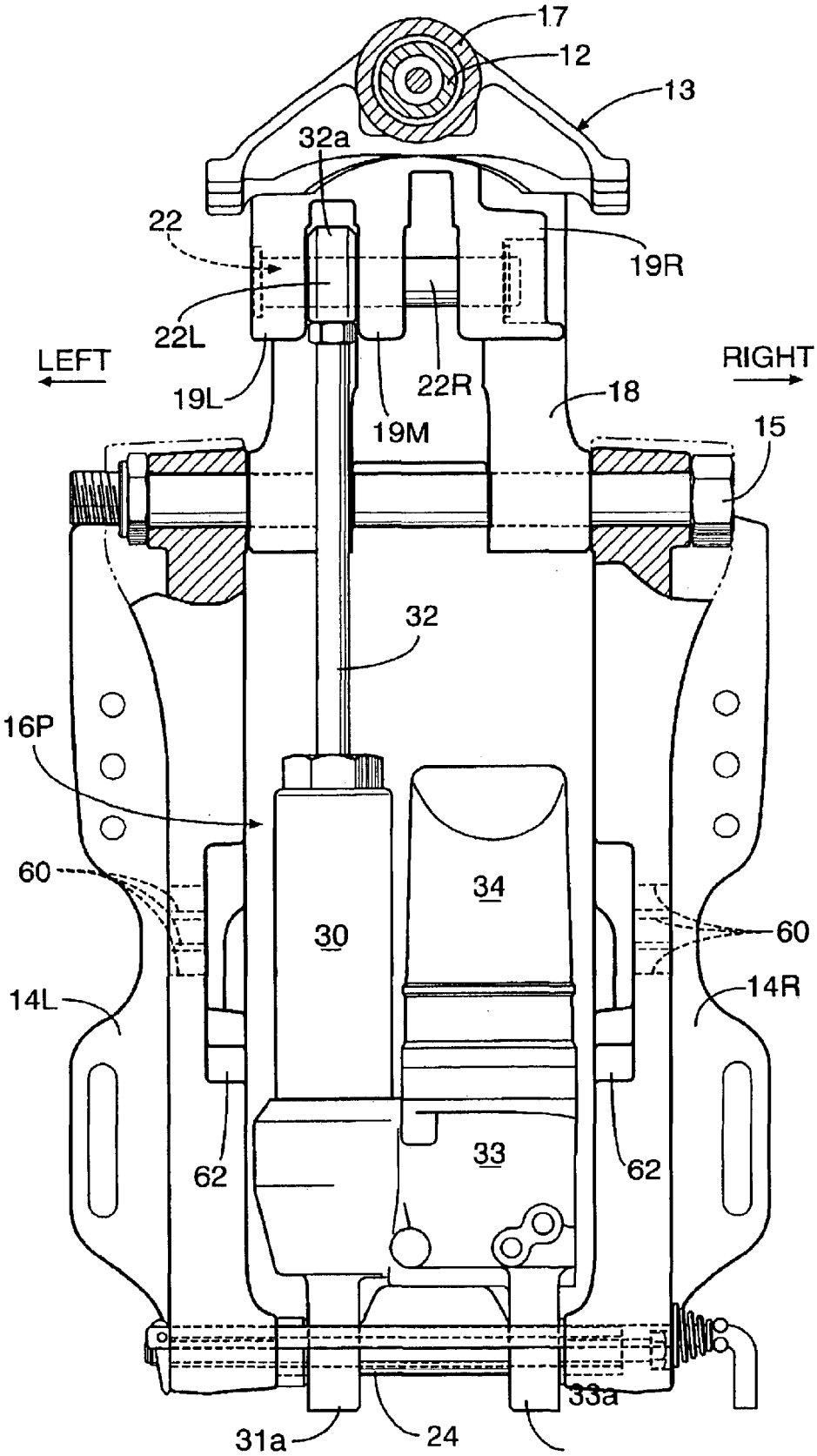
FIG. 8 is a cross sectional view taken along line 8—8 in FIG. 7.
Figure 9:
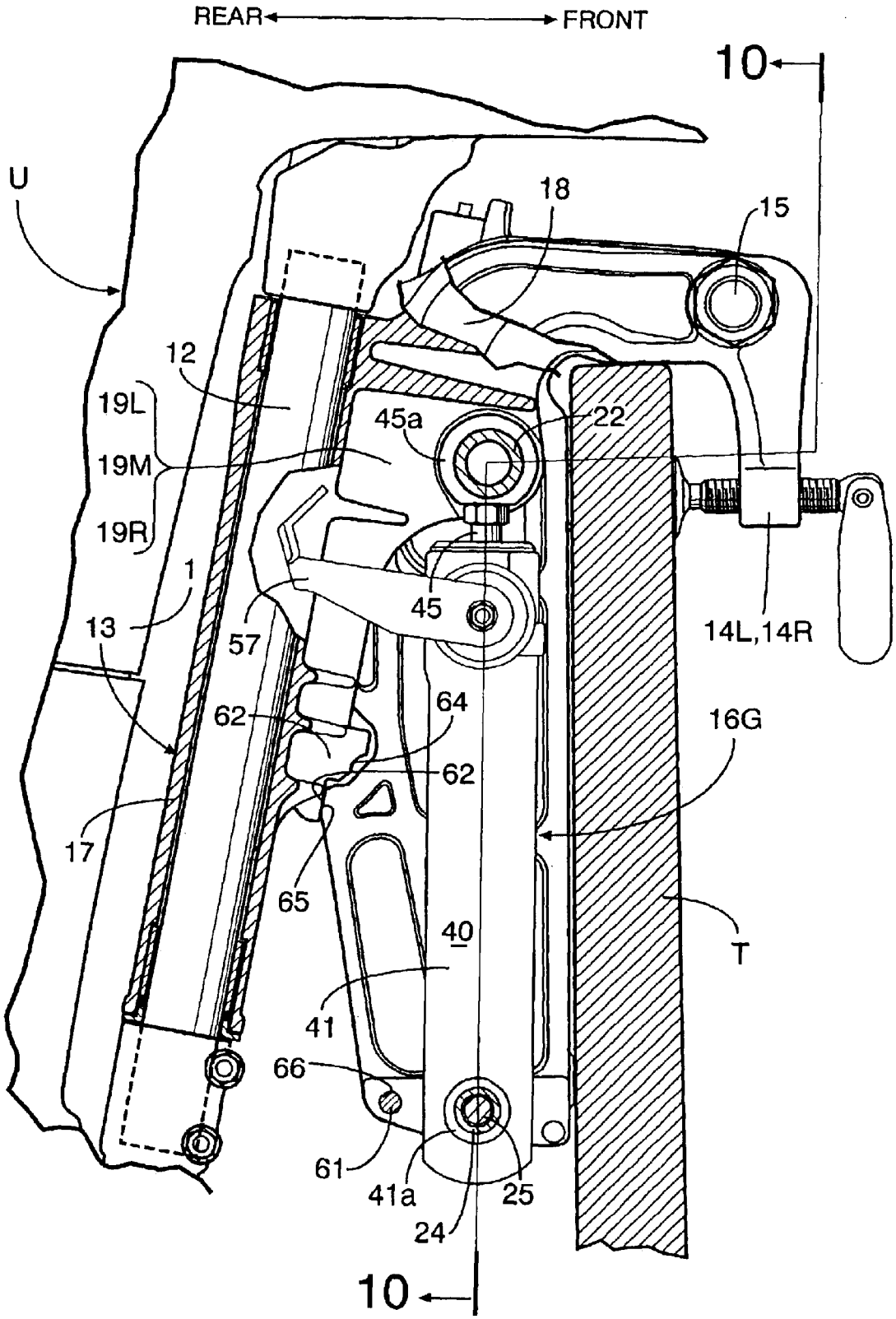
FIG. 9 is a view, corresponding to FIG. 2, showing a mode in which a gas-assist type tilt system is mounted.

As shown in FIG. 4, formed integrally with one end of the stopper pin 61 are a retaining projection 67 and a knob 68 which is bent toward one side from the axially outer end of the retaining projection 67. A conical coil spring 69 is fitted around the stopper pin 61 and is caught by the retaining projection 67. A retaining key 70 is pivotably connected to the other end of the stopper pin 61 via a pivot 71 running transversely through the stopper pin 61. This retaining key 70 can pivot between a dropped down position A in which it is coaxial with and has the same diameter as the stopper pin 61, and a raised position B in which it is perpendicular to the stopper pin 61.

When fitting the stopper pin 61, the retaining key 70 is set at the dropped down position A and the stopper pin 61 is inserted through a selected pair of adjustment holes 60 with the retaining key 70 ahead. When the coil spring 69 is compressed on the outer side surface of one stern bracket 14R and, at the same time, the retaining key 70 projects out of the outer side surface of the other stern bracket 14L, the retaining key 70 is made to pivot to the raised position B and the insertion force is released from the stopper pin 61. As a result, the retaining key 70 is retained in a state in which it keeps an upright attitude and abuts against the outer side surface of said other stern bracket 14L due to the resilient force of the coil spring 69, thus preventing the stopper pin 61 from becoming detached from the adjustment holes 60 and also preventing noise due to rattling of the retaining key 70. In order to pull the stopper pin 61 out of the adjustment holes 60, a procedure opposite to the above is conducted.

The retention holes 66 for retaining the unused stopper pin 61 are bored in a lower part of the left and right stern brackets 14L and 14R where there is no interference with the swivel case 13. These retention holes 66 have the same dimensions as those of the adjustment holes 60, and the thus stopper pin 61 can be easily fitted in the retention holes 66 in the same manner as it is fitted in the adjustment holes 60.

The present invention is not limited to the above-mentioned embodiment and can be modified in a variety of ways without departing from the spirit and scope of the present invention.

What is claimed is:

1. An outboard motor comprising a swivel case axially and steerably supporting a propulsion unit, a pair of left and right stern brackets disposed on left and right sides of the swivel case and supporting the swivel case in a vertically tiltable manner via a tilt shaft, and an upper pivot shaft and a lower pivot shaft that are parallel to the tilt shaft and are provided in the swivel case and the left and right stern brackets respectively, upper and lower end portions of an extendable part of a tilt system being mounted on the upper and lower pivot shafts, wherein the upper pivot shaft is provided with first and second mounting parts that are offset in mutually opposite left and right directions from a central position between the pair of stern brackets, the offset of the second mounting part is set smaller than the offset of the first mounting part, and the upper end portion of the extendable part of the tilt system is mounted selectively on one of the first and second mounting parts according to the type of tilt system.

2. The outboard motor according to claim 1 wherein the tilt system is of a power type in which a hydraulic pump and an electric motor are connected to one side of a hydraulically operated cylinder, an upper end part of the hydraulically operated cylinder is mounted on the first mounting part, and the hydraulic pump and the electric motor are disposed on the second mounting part side.

3. The outboard motor according to claim 1 wherein the tilt system is of a gas-assist type in which a cylindrical accumulator tank is connected to one side of an assist cylinder, an upper end part of the assist cylinder is mounted on the second mounting part, and the accumulator tank is disposed on the first mounting part side.

4. The outboard motor according to any one of claims 1 to 3 wherein the pair of left and right stern brackets are provided with a plurality of sets of pairs of left and right adjustment holes arranged in the vertical direction, a stopper pin that determines the tilted down position of the propulsion unit by receiving a stopper surface formed on a front surface of the swivel case is inserted through and supported selectively in one pair of the plurality of sets of adjustment holes so as to adjust the tilted down position of the propulsion unit in a plurality of steps, the swivel case has a second stopper surface formed below the stopper surface, the stern brackets have formed thereon a stopper wall that defines the lowest tilted down position of the propulsion unit by receiving the second stopper surface when the stopper pin is detached from the adjustment holes, and these stern brackets are provided with retention holes that retain the stopper pin detached from the adjustment hole.

5. The outboard motor according to claim 4 wherein, when the second stopper surface is received by the stopper wall, the swivel case is held between the two stern brackets.

6. The outboard motor according to claim 4 wherein, when the stopper pin is inserted into the adjustment holes or the retention holes, a retaining key is axially supported on one end part of the stopper pin so that the retaining key can pivot between a dropped down position in which the retaining key is coaxial with the stopper pin and can pass through the adjustment holes or the retention holes together with the stopper pin, and a raised position in which the retaining key abuts against an outer side surface of one of the stern brackets, and a spring is fitted to the other end part of the stopper pin, the spring being compressed against an outer side surface of the other stern bracket and biasing the stopper pin in a direction opposite to the retaining pin.

* * * * *